US005390380A

United States Patent [19]

James-Wallace

[11] Patent Number: 5,390,380

[45] Date of Patent: Feb. 21, 1995

[54] STABILISED BED WITH HOIST

[76] Inventor: Wallace James-Wallace, P.O. Box 30, Albany 6330, Western Australia, Australia

[21] Appl. No.: 958,130

[22] PCT Filed: Jun. 27, 1991

[86] PCT No.: PCT/AU91/00276

§ 371 Date: Dec. 29, 1992

§ 102(e) Date: Dec. 29, 1992

[87] PCT Pub. No.: WO92/00052

PCT Pub. Date: Jan. 9, 1992

[51] Int. Cl.[6] ..... A61G 7/10

[52] U.S. Cl. ..... 5/84.1; 5/87.1; 212/260; 254/124

[58] Field of Search ..... 5/81.1, 83.1, 84.1, 5/87.1, 312, 662; 212/261, 260, 262, 263, 238; 414/921; 254/124

[56] References Cited

U.S. PATENT DOCUMENTS

| | | | |
|---|---|---|---|
| 795,524 | 7/1905 | Laffmann | 212/260 |
| 852,507 | 5/1907 | Henwood | 5/84.1 |
| 953,962 | 4/1910 | Lane | 5/87.1 |
| 2,272,778 | 9/1939 | Reuter . | |
| 2,809,381 | 10/1957 | Colaner | 5/87.1 |
| 2,846,091 | 8/1958 | Heffner | 5/87.1 |
| 2,891,256 | 6/1959 | Scully | 5/424 |
| 3,850,165 | 11/1974 | Throner | 5/84.1 |
| 4,144,713 | 3/1979 | Clark et al. . | |
| 4,194,253 | 3/1980 | Ullven . | |
| 4,375,707 | 3/1983 | Boerigter . | |
| 4,644,595 | 2/1984 | Daniel . | |
| 4,932,090 | 6/1990 | Johansson . | |
| 4,996,728 | 3/1991 | Nolan . | |
| 4,999,862 | 3/1991 | Hefty | 5/81.1 |
| 5,077,844 | 6/1992 | Twitchell | 5/81.1 |

FOREIGN PATENT DOCUMENTS

| | | | |
|---|---|---|---|
| 218600 | 3/1958 | Australia . | |
| 56663/80 | 9/1980 | Australia . | |
| 91096/82 | 5/1984 | Australia . | |
| 0400664 | 6/1990 | European Pat. Off. . | |
| 680659 | 8/1929 | France | 212/8 |
| 3908379 | 9/1989 | Germany . | |
| 2179625 | 3/1987 | United Kingdom . | |
| 2222814 | 3/1990 | United Kingdom . | |

*Primary Examiner*—Flemming Saether
*Attorney, Agent, or Firm*—Larson and Taylor

[57] ABSTRACT

A bed having a lifting apparatus for raising and lowering an object, such as a person, onto and off the bed, and a stabilizing leg for stabilizing the bed against transverse tipping forced induced by the operation of the lifting apparatus. The lifting apparatus is pivotally attached to the bed by a boss and has a jib for attachment to the object. The jib being able to be moved between stops for the transfer of the object onto the off the bed. Reinforcement is provided to inhibit excessive deflection of the bed so as to maintain an axis of pivot of a mast of the lifting apparatus disposed substantially vertically. Various reinforcing arrangements are proposed for beds of differing purpose and construction. A spigot carrier is provided for mounting the mast onto a boss of the bed and has bearings for acting in relation to axial and radial forces from the lifting apparatus.

9 Claims, 5 Drawing Sheets

STABILISED BED WITH HOIST

DESCRIPTION

The present invention relates to stabilised bed and a hoist (lifting apparatus) therefor.

FIELD OF THE INVENTION

There are growing concerns about the occurrence of lower back injuries to nursing staff in hospitals due to lifting of patients onto and off hospital beds. It is known to use a mobile lifting apparatus to lift patients off and onto hospital beds. Such known mobile lifting apparatus are provided with wheels and incorporate straps or a harness or the like to locate about a patient. The patient can be raised or lowered by the apparatus when in the harness and the apparatus can be manoeuvred by wheeling so as to move the patient above or away from the hospital bed. A disadvantage of such apparatus is that more than one person is generally required to operate the lifting apparatus in order to manipulate the patient. Also, since the apparatus must be wheeled so as to move the patient onto or off the hospital bed one person is even less likely to be able to safely perform the task. Once moved away from the hospital bed the patient may be lowered into a wheelchair or commode or bedside bath or the like. A further disadvantage of mobile lifting apparatus is that they are generally stored at a distance from where they are required for use. Also, a person desiring to use the mobile lifting apparatus must first find it, as it may have been moved to another part of the hospital. Due to these difficulties nursing staff often move patients by hand so as to save time and back injuries to the staff tend to occur as a result.

It is desired to overcome these problems by providing a hoist mounted upon a bed for raising and lowering a person above and beside the bed.

The sick and infirm receive treatment in hospitals, nursing homes, permanent care institutions, retirement villages and their private homes. A wide range of beds are designed to meet the individual needs of these various situations. It has been found in practice and by calculation that these beds have not been adequately designed to operate under the stresses placed upon them by the use of bed mounted hoists. Accordingly, it is generally necessary to reinforce the bed. The manner in which the reinforcement is undertaken depends on the type of bed. For example, an existing bed may have reinforcing braces conveniently welded onto its frame or its base in the region of mounting of the hoist. Alternatively, a portion of the frame or the base could be removed and replaced with metal beams of greater strength and rigidity. A new bed may be manufactured with metal of greater strength and rigidity.

SUMMARY OF THE INVENTION

It is therefore an object of the present invention to provide a lifting apparatus capable of removable location on a bed so that it is always available for moving the patient onto and off the bed.

In accordance with one aspect of the present invention there is provided a lifting apparatus for moving an object onto and off a bed, the lifting apparatus characterised in that it comprises:

a mast mounted on the bed for pivoting about a substantially vertical axis;

a jib pivotably attached proximate a top of the mast such that a free end of the jib can be disposed higher than the top of the mast, the jib allowing raising and lowering of the object; and, a lifting member attached between the mast and the jib for pivoting about a substantially horizontal axis for effecting raising and lowering of the free end of the jib for raising and lowering the object;

the mast having an elbow located intermediate its length and the jib having an elbow located intermediate its length, the elbow of the jib being pivotably attached to the top of the mast and one end of the lifting member being attached proximate the elbow of the mast and the other end of the lifting member being attached proximate a second end of the jib remote from the free end;

whereby, in use, the mast can be pivoted about a vertical axis between a first position for raising and lowering the object with the jib above the bed and a second position for raising and lowering the object with the jib adjacent the bed.

The attachment means may be mounted onto a frame of the bed or onto a base of the bed. The latter is appropriate where the bed has a frame that can be tilted, for example, trendelenburg (i.e. head down say 15°) and reverse trendelenburg (i.e. head up say 15°), as employed in some hospital beds.

The bed may be a hospital bed, a permanent care unit or a domestic bed.

Preferably, a lifting member is attached between the mast and the jib for pivoting the jib about a substantially horizontal axis for effecting raising and lowering of a free end of the jib.

Preferably, the mast is bent intermediate its length and one end of the lifting member is attached to the mast proximate an elbow of the bend, the other end of the lifting member being attached to the jib.

Preferably, the jib is pivotably attached intermediate its length onto the mast.

Preferably, the jib is bent intermediate its length at an elbow, and the elbow is pivotably attached onto the mast. Hence, the lifting member is attached to a first end of the jib for raising and lowering a second free end of the jib located opposite the elbow from the first end.

Preferably, stops are provided for limiting the arc of pivoting of the mast with respect to the attachment means.

Preferably, there is provided a stabilising leg arranged to be disposed transversely outwardly from the bed or the attachment means so as to stabilise the bed against transverse tipping forces encountered when pivoting the mast for raising and lowering the object adjacent the bed.

Typically, the attachment means is a spigot or pipe designed to mate with a boss of a hospital bed. A boss is conventionally provided on hospital beds to receive a tubular support from which depends a support ring for use by patients in raising and lowering themselves bodily on the hospital bed—conveniently referred to as a self help pole.

The stabilising leg may be provided with a spigot to mate with the boss on the hospital bed or at a suitably located boss designed for this purpose. For example, the boss could be located at a corner of the bed.

Preferably, the jib is coupled to the object with a spreader bar carrying a harness for the purpose.

In accordance with another aspect of the present invention there is provided a bed adapted for having a lifting apparatus attached to it, the bed being characterised in that it has:

an attachment means for pivotably attaching a mast of the lifting apparatus to the bed for raising and lowering an object above and adjacent the bed, the attachment means being located proximate one corner of a base frame of the bed, the attachment means co-acting with the mast for providing a low friction support with respect to axial and radial forces and moments of inertia about the attachment means, the attachment means allowing substantially free pivoting of the lifting apparatus with respect to the bed; and, means for reinforcing the bed frame in the region of the attachment means for inhibiting excessive deflection of the bed frame during use of the lifting apparatus, the reinforcing means extending at least part way along two adjoining sides of the bed frame;

whereby, in use, the low friction support can allow relatively easy pivoting of the lifting apparatus with respect to the bed frame about a substantially vertical axis of pivot and the low friction support also maintains the axis of pivot substantially vertically.

In accordance with a further aspect of the present invention there is provided a stabilising leg for a bed having a lifting apparatus for moving an object onto and off the bed, the stabilising leg comprising:

a mounting means for mounting onto the bed; and, a leg having a foot, the leg depending from the mounting means, and the foot being disposed proximate a surface upon which the bed rests;

whereby, in use, the stabilising leg can be arranged to be disposed outwardly from the bed to stabilise the bed against transverse tipping forces, induced by the lifting apparatus, in one position and disposed for allowing wheeled movement of the bed in another position.

Typically, the attachment means is a spigot designed to mate with a boss provided on a frame of a hospital bed or a suitably located boss designed for the purpose.

Typically, the attachment means includes a coupling for pivotably coupling a lifting apparatus onto the bed.

Preferably, the leg also includes an adjusting element for bringing the foot into close proximity or contact with a surface upon which the bed rests, for example, a building floor.

The attachment means may be a sleeve disposed for telescopically receiving the leg for moving the leg between a storage position and an in use position.

The attachment means may alternatively be a pivot for pivotably attaching the leg to the bed for moving the leg between the storage and use positions.

The present invention will herein after be described with particular reference to use in connection with beds such as hospital beds. However, it is equally applicable to other types of beds, such as, for example, permanent care units and domestic beds.

Hereinafter the lifting apparatus shall be referred to as a hoist.

BRIEF DESCRIPTION OF THE DRAWINGS

A preferred embodiment, being an example only, of the present invention, will now be described with reference to the accompanying drawings, in which.

DESCRIPTION OF THE INVENTION

Figure 1:
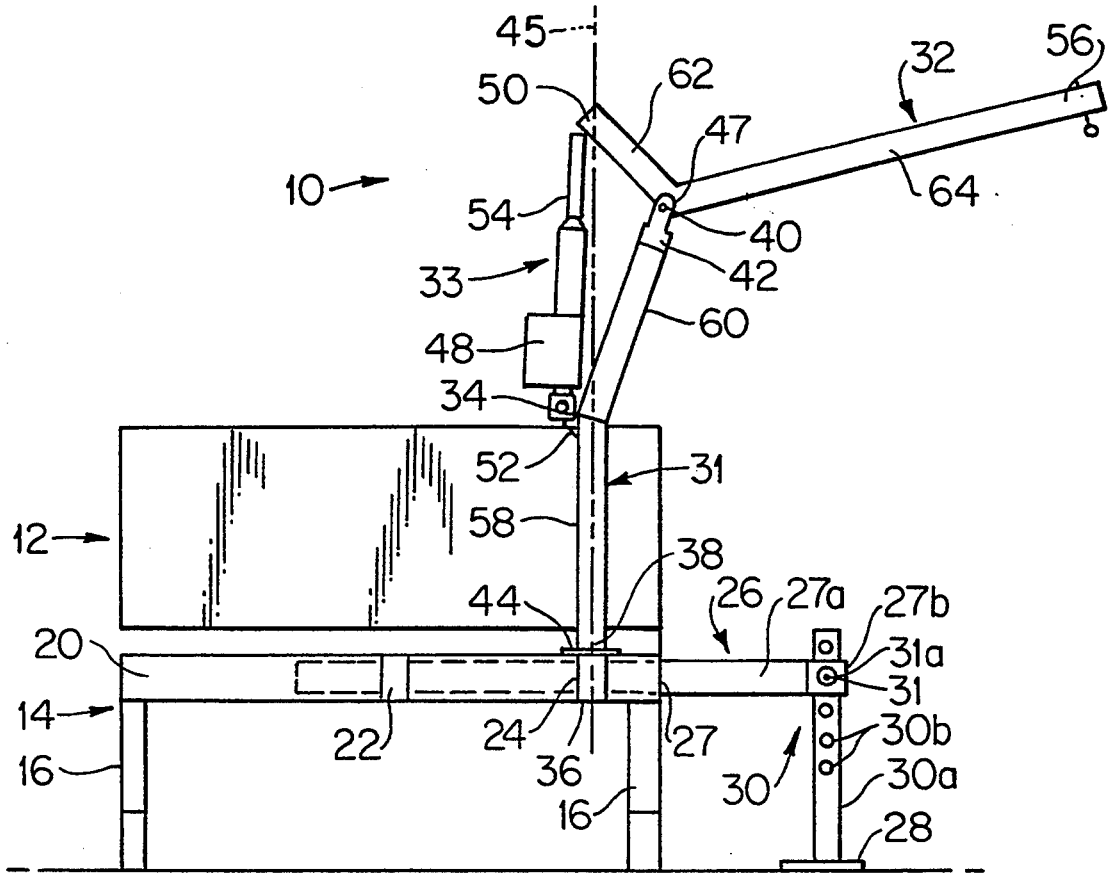
FIG. 1 is a rear end view of a hoist shown attached to a hospital bed provided with a stabilising leg shown partway extended.

In FIG. 1 there is shown a hoist 10 pivotably mounted upon a hospital bed 12.

The hospital bed 12 comprises a base frame 14 having four legs 16 each with lockable wheels pivotably attached to a lower most end of the legs 16. The base frame 14 includes a rear beam 20 upon which is mounted two spaced apart bosses 22 and 24. The rear beam 20 has a stabilising leg 26 telescopically maintained in it. The rear beam 20 is box shaped in section and has an open end 27. The stabilising leg 26 has a box section shaped beam 27*a* sized to slide within the rear beam 20 between a position wherein the beam 27*a* fits almost entirely within the beam 20 and a position wherein the beam 27*a* fits only partly within the beam 20. The leg 26 comprises a foot 28 depending downwardly towards a floor upon which the hospital bed 12 rests. The leg 26 also conveniently includes an adjusting element 30 typically in the form of a post 30*a* with a plurality of spaced apart holes 30*b* through it. The holes 30*b* are capable of registering with a hole 31 in an end 27*b* of the beam 27*a* remote from the rear beam 20 of the bed 12. A pin 31*a* is received in one of the holes 30*b* and the hole 31 to allow for adjustment of the distance between the foot 28 and the end 27*b* of the beam 27*a* so as to reach the floor even where the height of the hospital bed 12 is altered.

The boss 22 conventionally forms part of the hospital bed 12 and is intended to receive a tubular support from which depends a support ring for use by patients in raising and lowering themselves bodily on the hospital bed 12. The boss 22 is not well suited for receiving the hoist 10 since it is not sufficiently strong and causes excessive twisting in the base frame 14. Therefore the second boss 24 is located on the beam 20 and constitutes the attachment means of the present invention. The boss 24 may be located intermediate of the conventional boss 22 and one end of the beam 20 of the base 14 or at the end of the beam 20 (see FIGS. 7 to 10). Alternatively, the second boss 24 could be located at some other suitable location on the base frame 14, such as, for example, on a longitudinal beam 20*a* (FIG. 8) and adjacent the rear beam 20. However, it is preferred that the boss 24 be located at the end of the beam 20 since this enables maximum sluing of the hoist 10 off the bed 12 and reduces twisting in the base frame 14. Typically, two such bosses are provided, one located proximate each end of the beam 20.

Figure 1A:
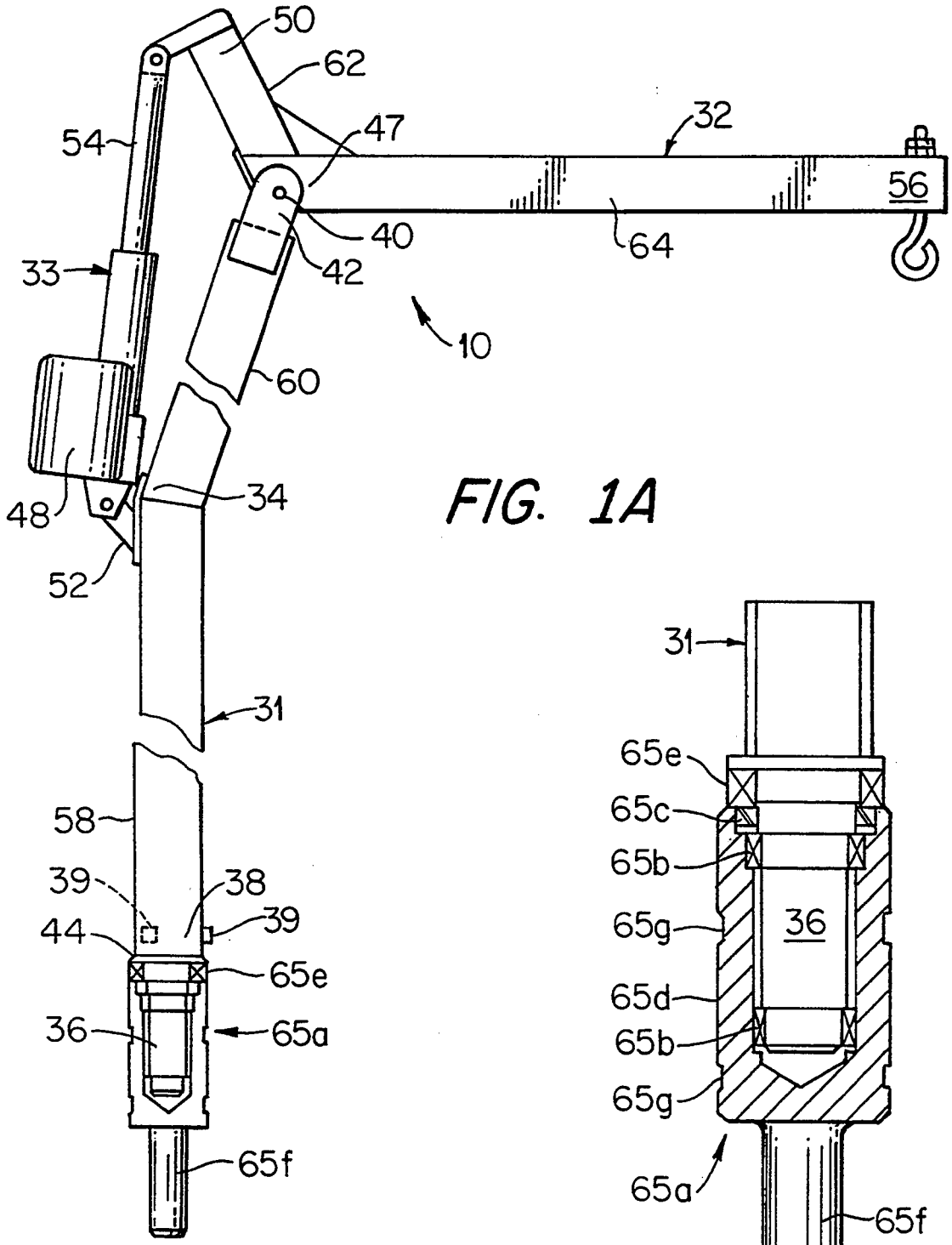
FIG. 1*a* is an enlarged side view of the hoist of FIG. 1, shown mounted onto a spigot or mast carrier.

As shown in FIGS. 1 and 1*a* the hoist 10 comprises a mast 31, a jib 32 and a lifting member 33. The mast 31 has an elbow 34 located intermediate its length, a spigot or mast axle 36 located at one end 38 and a pivot 40 located at an opposite end 42. The spigot 36, as shown in FIG. 1, is dimensioned to pivotably fit into the boss 24 and is terminated at a turntable 44 disposed to bear upon the boss 24. The spigot 36 and the turntable 44 allow for pivoting of the hoist 10 about a substantially vertical axis 45 with respect to the hospital bed 12.

The jib 32 is coupled via an elbow 47, located intermediate of its length, to the pivot 40. The lifting member 33 has a linear drive motor 48 pivotally coupled between one end 50 of the jib and a mounting lug 52 located proximate the elbow 34 of the mast 31. The drive motor 48 has a ram 54 which is connected to the end 50 of the jib 32. Electrical actuation of the drive motor 48 for shortening and lengthening of the ram 54 results in raising and lowering of an end 56 of the jib 46 remote from the end 50.

The mast 31 has a first shaft 58 and a second shaft 60. The first shaft 58 is intended to be disposed vertically above the hospital bed 12 and the second shaft 60 is disposed at a predetermined angle to the first shaft 58. The jib 32 has a first elongate element 62 and a second elongate element 64 at an obtuse angle to the first elongate element 62. The angle between the two shafts 58 and 60 and the angle between the two elongate elements 62 and 64 are selected so that the drive motor 48 is disposed substantially vertically.

Figure 1B:
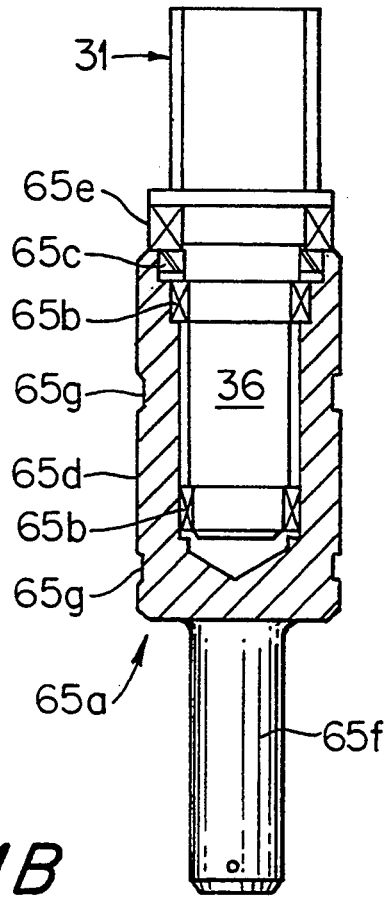
FIG. 1*b* is a further enlarged view of the spigot carrier of FIG. 1*a;*

The spigot 36 of the hoist shown in FIG. 1*a* is designed to be journalled into a spigot or mast carrier 65*a*, shown in more detail in FIG. 1*b*. The spigot carrier 65*a* has two needle roller bearings 65*b* and an oil seal 65*c* located between the spigot 36 and a wall 65*d* of the spigot carrier 65*a*. A thrust bearing 65*e* is located between the turntable 44 and a top of the spigot carrier 65*a* for transmitting vertical load from the mast 31 to the spigot carrier 65*a*. The spigot carrier 65*a* also has a spigot end or shaft 65*f* designed to be received in the boss 24. The wall 65*d* of the spigot carrier 65*a* typically has circumferential grooves 65*g* for having a stabilising leg, according to the embodiment of FIG. 6 clamped to it as described hereinafter.

Figure 2:
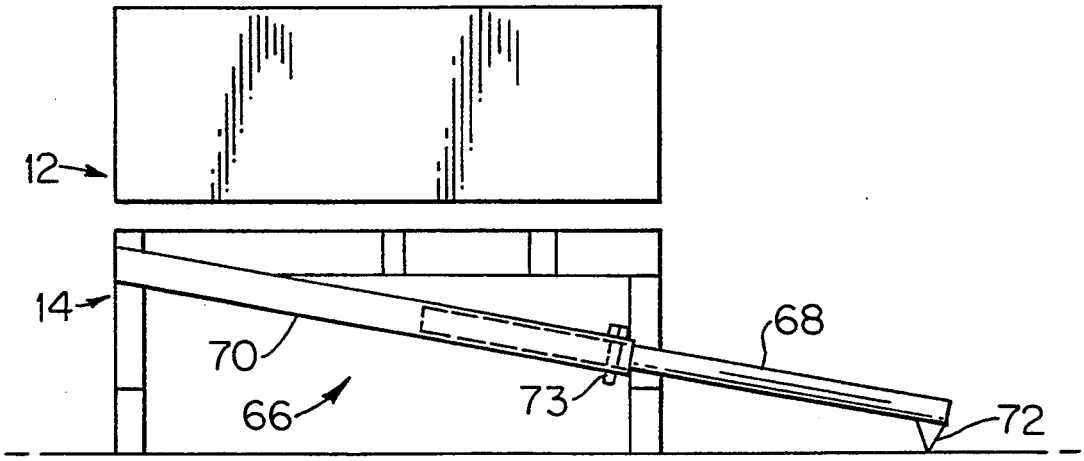
FIG. 2 is a rear end view of a hospital bed having a further embodiment of a stabilising leg.

In FIG. 2 there is shown a further stabilising leg 66 according to another embodiment. The further stabilising leg 66 comprises a shaft 68 telescopically movable into and out of a sleeve 70. The sleeve 70 is fixed to the base 14 of the hospital bed 12. The shaft 68 is provided with a foot in the form of a stopper 72 intended to bear against the surface upon which the hospital bed 12 rests. A fixing bolt 73 is provided to be inserted into holes in the shaft 68 and the sleeve 70 to fix the shaft 68 within the sleeve 70 at a desired length so that the stopper 72 bears against the surface. The fixing bolt 73 and the holes constitute an adjusting element for the leg 66.

Figure 3:
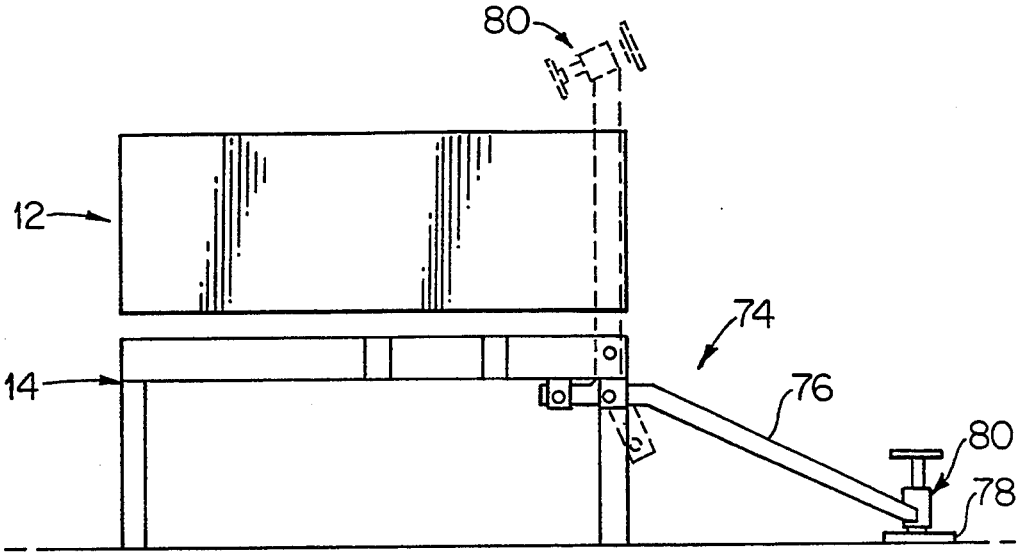
FIG. 3 is a rear end view of a hospital bed having a still further embodiment of a stabilising leg.

In FIG. 3 there is shown an embodiment of a still further stabilising leg 74. The still further stabilising leg 74 comprises a leg 76 pivotally attached to one of the legs 16 of the base 14. The leg is provided with a foot 78 having a screw-threaded adjusting element 80 attached thereto, so that the distance from the foot 78 to the pivot of the leg 76 can be adjusted. The leg 76 may be pivoted from a first position wherein the foot 78 bears against the surface and a second position wherein the foot 78 is disposed above the hospital bed 12. The leg 76 may be lockable in both positions.

Figure 4:
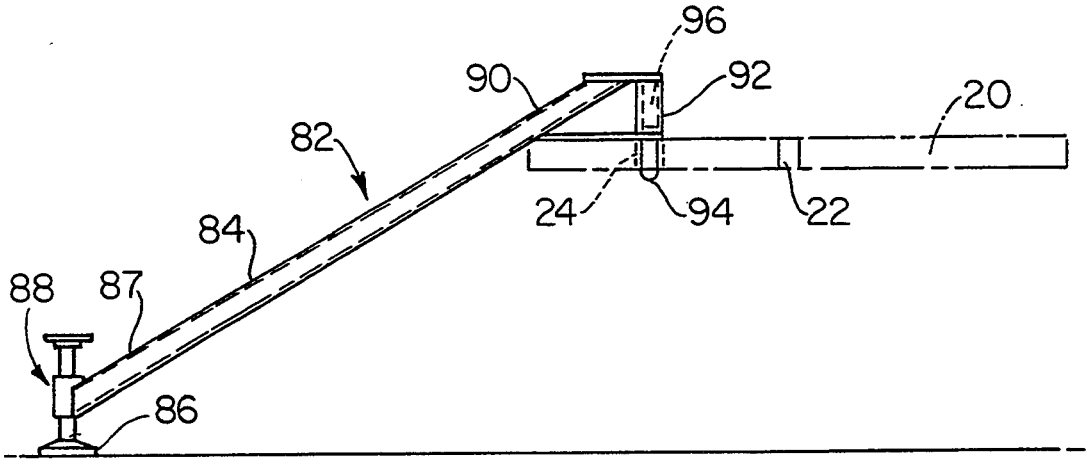
FIG. 4 is a rear end view of a still further embodiment of a stabilising leg shown attached to a bed base, the bed base shown in broken outline.

In FIG. 4 there is shown a still further stabilising leg 82 comprising a leg 84 having a foot 86 attached at one end 87. The foot 86 is provided with an adjusting element 88 identical to the adjusting element 80. At an end 90 of the leg 84 opposite the foot 86 there is located a coupling 92 and an attachment means in the form of a spigot or shaft 94. The spigot 94 is disposed to mate with the boss 24 of the bed base 14. The coupling 92 is provided with a hole 96 having an internal diameter equivalent to the internal diameter of the bosses 22 and 24. The hole 96 is designed to receive the spigot 36 of the hoist 10.

Figure 5:
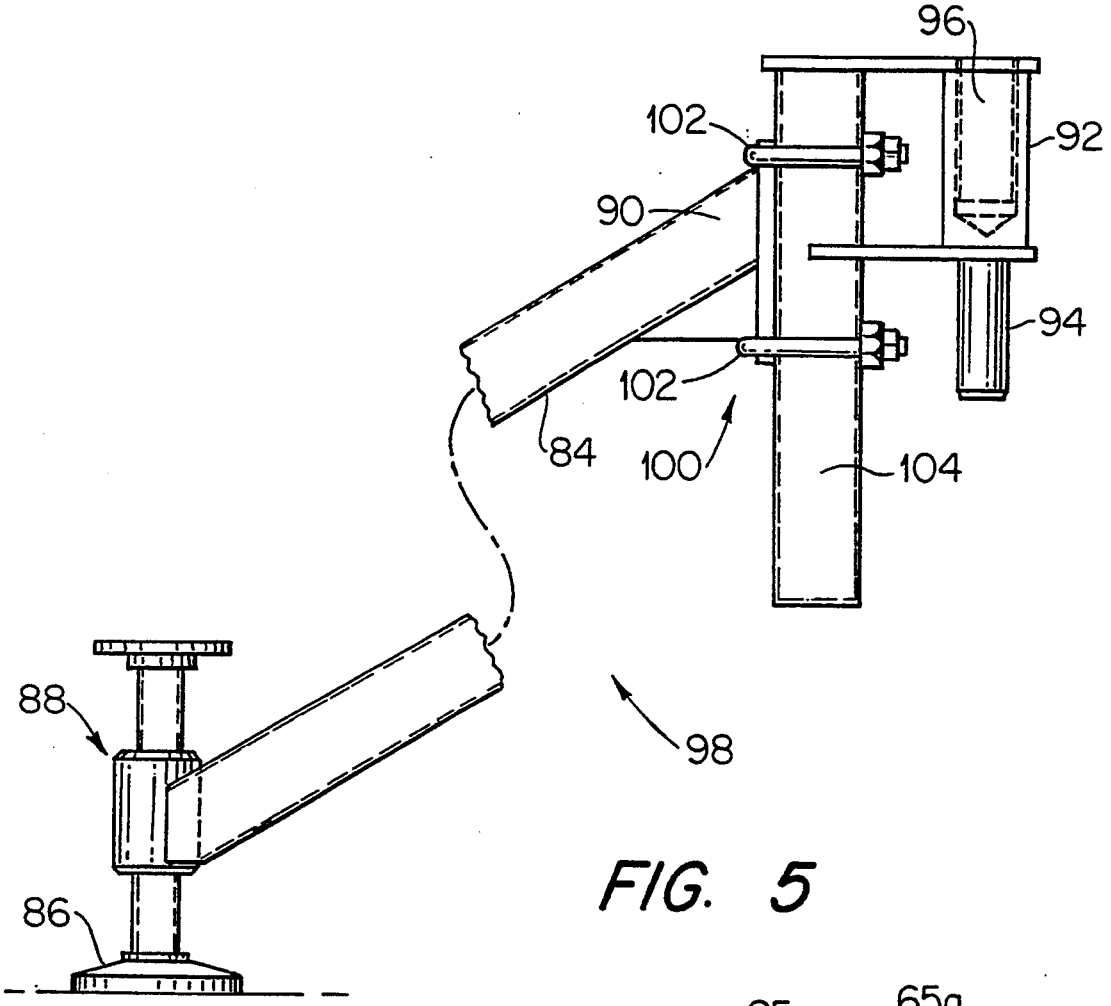
FIG. 5 is a further embodiment of the stabilising leg of FIG. 4.

In FIG. 5 there is shown an alternative stabilising leg 98 similar to the stabilising leg 82 and like numerals denote like parts. The alternative stabilising leg 98 comprises a height adjustor 100 located at the end 90 of the leg 84. The height adjustor 100 comprises two U bolts 102 securable about a shaft 104 depending from the coupling 92 and the spigot or shaft 94. The U bolts 102 allow for adjustment of the height of the junction of the end 90 of the leg 84 with the shaft 104. The adjustor 100 allows for added height adjustment of the leg 98 so as to allow for, use in, connection with a wider range of heights of hospital beds 12.

Figure 6:
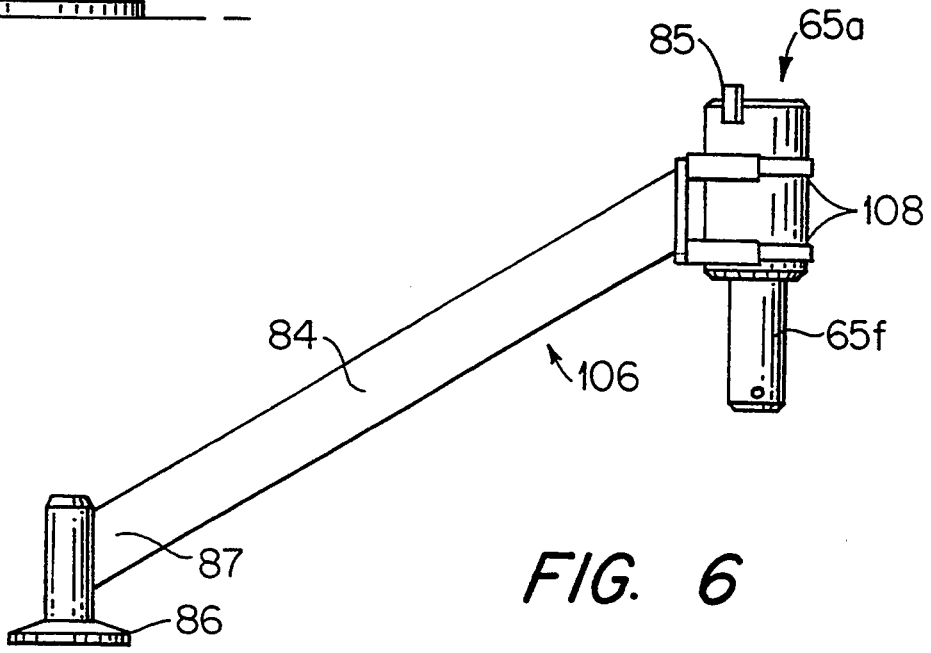
FIG. 6 is a side view of a still further embodiment of the stabilising leg of FIG. 4, shown attached to the spigot carrier of FIG. 1*b;*

In FIG. 6 there is shown a further alternative stabilising leg 106 similar to the stabilising legs 82 and 98 and like numerals denote like parts. The stabilising leg 106 has two clamps 108 for clamping about the circumferential grooves 65*g* of the spigot carrier 65*f*. It is intended that the leg 84 be of sufficient length that the foot 86 is disposed within about 2 mm of the surface upon which the bed 12 rests so that the bed 12 can be moved without regard for the stabilising leg 106 and slight deflection of the bed 12, in use, causes contact of the foot 86 with the surface.

The location of the boss 24 can assist in reducing twist that may be induced into the rear beam 20 during use of the hoist 10. The twist induced depends on the strength of the rear beam 20 and the load being lifted by the hoist 10. The amount of twist likely to be induced can be reduced by careful location of the boss 24. The twist can be substantially reduced by locating the boss 24 at or adjacent the junction of the rear beam 20 and the longitudinal beam 20*a*. Where one of the stabilising legs 26, 66, 74 or 98 are used the boss 24 is preferably located at or adjacent an intersection (or approximate intersection) of the rear beam 20, the longitudinal beam 20*a* and the stabilising leg 26, 66, 74 or 98. That is, the boss 24 is preferably located to take best advantage of the rear beam 20, the stabilising leg 26, 66, 74 or 98 and is approximately located on a centre line of the longitudinal beam 20*a*.

The boss 24 so located also allows the jib 46 to slue clear of the bed 12 a greater distance than would be possible if the boss 24 was located in board from the end of the beam 20 or if the boss 22 was used.

Hospital beds are not designed to withstand large stress loadings. Australian Standards Association requires that hoists on beds be capable of operating at a safe working load of at least 127 kg and that the hoist and the bed be capable of operating under a test of 25 times the safe working load, i.e. at least 317.5 kg. Tests have shown that such loads generally destroy the hospital bed. Engineering tests show that the 317.5 kg test load produces a maximum moment of 2 kNm which represents 125% of the yield stress of a conventional hospital bed frame which has an ERW tube of section 50.8 mm×31.8 mm and a wall thickness of 1.6 mm.

Further tests showed that the same test load represents only 66% of the yield stress of a specially reinforced hospital bed frame using Grade 350 RHS of section 65 mm and 35 mm and a wall thickness of 3 mm. Under such test loads the RHS section deflected an acceptable 6 mm whereas the ERW tube section deflected an unacceptable (and potentially catastrophic) 18 mm. The deflections under safe working loads will be about 2.4 mm and 7.2 mm respectively. Therefore, in the context of the present invention "inhibiting deflection of the bed" does not mean that the bed must not deflect, but that it may deflect say 6 mm or so provided the resultant deflection is with safe structural limits for the bed.

Figure 7:
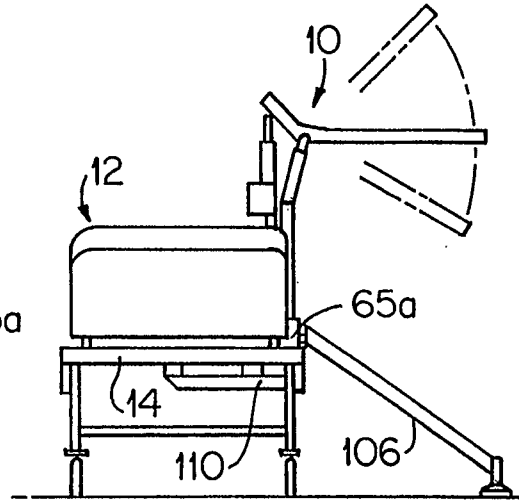
FIGS. 7 and 8 are front end and side views, respectively, of a hospital bed shown having its frame reinforced with brackets and provided with the hoist of FIG. 1*a* and the stabilising leg of FIG. 6; and, FIGS. 9 and 10 are front end and side views, respectively, of a hospital bed, shown with the hoist of FIG. 1*a* mounted onto a base of the hospital bed.
Figure 8:
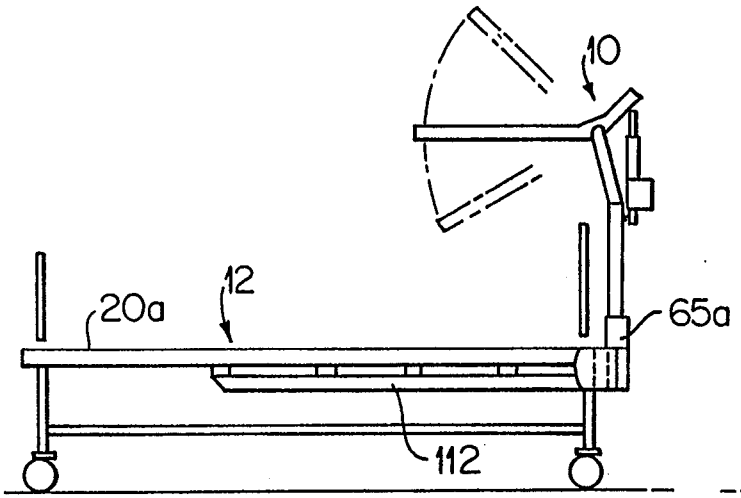

Therefore, in the present embodiment the bed 12 is preferably reinforced in the region of the boss 24 to inhibit deflection of the hospital bed frame 14 to an amount that is safe as regards the safe working load for which the bed is designed. In FIGS. 7 and 8 reinforcing braces 110 and 112 are fixed to the bed frame 14 for this purpose. Alternatively, the bed frame 14 can be made of heavier gauge metal to achieve the same effect. Preferably, the braces 110 and 112 or the heavier gauge frame 14 provide stiffness equivalent to or greater than that achievable if Grade 350 RHS 65×35×3 mm were used for forming the frame 14.

Figure 9:
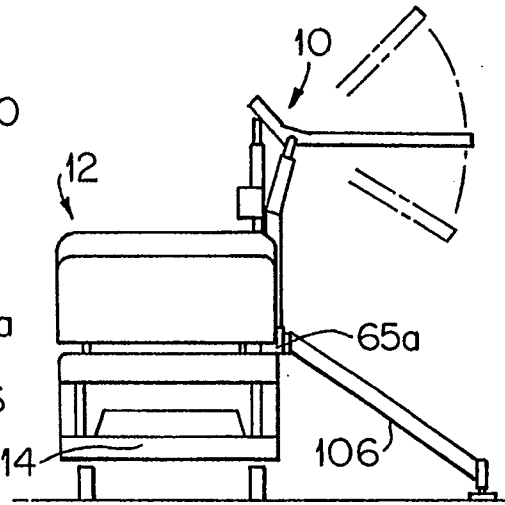
Figure 10:
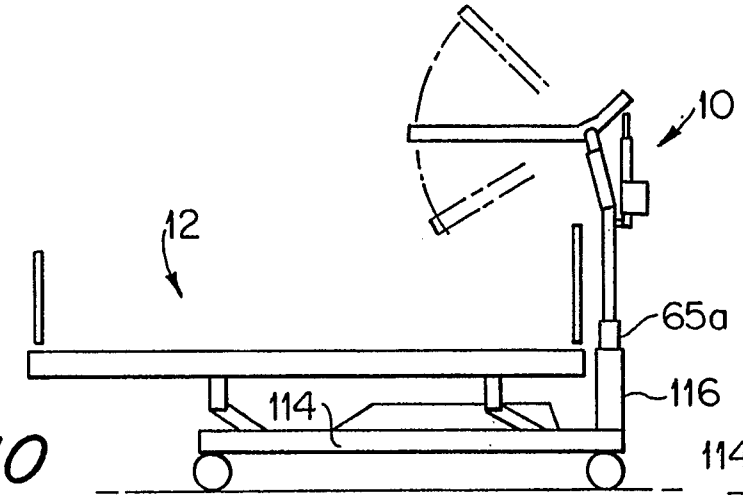

In FIGS. 9 and 10 there is shown a hospital bed 12 with a bed frame 14 which can be raised and lowered and tilted head up or head down. In order to avoid having to adjust the stabilising leg during such movements of the bed frame it is preferred that the hoist be mounted onto a bed base 114 of the bed 12. Accordingly, a standard 116 is provided atop which the boss 24 is disposed.

Preferably, stops 39 and 83 are provided to limit the arc of pivoting of the mast 31 about the vertical axis 45 so as to keep the jib 32 in a region bounded by the bed 12 and the stabilising leg.

The operation of the hoist 10 will now be described in a typical hospital situation with reference to FIG. 1.

In use, the hoist 10 is pivotably mounted onto hospital bed 12 by location of the spigot 36 into one of the bosses 22 or 24. The stabilising leg 26 is then drawn out from the bed 12 so as to telescope out of the rear beam 20 of the hospital bed 12. The foot 28 is then adjusted so as to bear against or close to the surface upon which the hospital bed 12 rests. A harness (not shown) is then positioned about a patient to be lifted from the bed 12. The drive motor 48 is operated to extend the ram 54 to lower the end 56 of the jib 48 downwardly toward the patient. The harness is then coupled to a spreader bar attached to end 56 and the drive motor 48 operated to shorten the ram 54 and to raise the patient above the bed 12. The mast 31 is then pivoted with respect to the hospital bed 12 about the vertical axis 45 by pushing the patient in a direction off the bed 12. The patient may then be lowered into a wheel chair or onto a bed bath or the like stationed adjacent the hospital bed 12. As the jib 32 is sleaved to move the patient off the bed 12 the stabilising leg 26 resists transverse tipping forces that may otherwise cause the bed to overturn.

The other stabilising legs 66, 74, 82, 98 and 106 may be used in a manner generally similar to the stabilising leg 26.

The present invention allows for convenient manoeuvring of patients onto and off hospital beds 12. Such manoeuvring can typically be achieved by as few as one or two persons. Conceivably the patient may be able to control raising and lowering of the jib 32 himself without the need for any assistance. The location of the boss 24 at the end of the beam 20 allows for maximum slewing of the jib 32 off the bed 12 to enable easy transfer of the patient onto another bed or wheel chair or the like. The stabilising legs 26, 66, 74, 82, 98 and 106 assist in maintaining stability of the hospital bed 12 during use of the hoist 10.

The stabilising legs are preferred to achieve this stability but may not always be essential, for example, where the bed 12 is fixed to the surface. Also, it has been found that where the hospital bed 12 is of sufficient mass and where the mass of the patient is sufficiently small overturning of the hospital bed 12 during use is unlikely. It has been found that the mass of conventional hospital beds varies between 54 kg and 110 kg. Where the mass of the bed is greater than the mass of the patient relatively safe manoeuvring of the patient may be possible provided the end 56 of the jib 46 is not slue too far off the hospital bed 12. Coupling of the stabilising leg into the boss 24 or to the spigot carrier **65*a* simplifies construction and reduces the transmission of twisting stresses through the base frame 14. Positioning of the foot of the stabilising leg slightly above the surface enables movement of the bed 12** with the stabilising leg in place.

The needle and thrust bearings **65*b* and 65*c* reduce the friction between the mast 31 and spigot carrier 65*a* and make sluing of the jib 32 easier, especially when a person is being hoisted by the jib 32. The oil seal 65*c* provides an amount of damping to the sluing action to avoid excessively rapid sluing. The stops limit the arc of sluing the jib 32 so as to maintain the hoisted person within an area over the bed 12 or between the bed 12** and the stabilising leg.

Reinforcement of the bed 12 inhibits excessive strains being induced in the base frame 14 which may destroy the bed 12. Reinforcement may be undertaken during manufacture of in kit form for existing beds 12. Rigidity of the base frame 14 is also required to inhibit excessive deviation of the axis of pivot 45 of the mast 31 from the vertical.

Modifications and variations such as would be apparent to a skilled addressee are deemed within the scope of the present invention.

I claim:

1. A stabilised bed with hoist, the bed being capable of moving patients onto it and of it, the bed having:

a frame supported upon a floor, the frame being able to support a person in a recumbent position and capable of wheeled motion over the floor;

a lifting means for lifting the person which is attached to the frame and pivotable with respect to the frame, the lifting means comprising:

a mast pivotally mounted to the frame, the mast having an elbow located intermediate its length, the mast being pivotable about a substantially vertical axis between a first position for raising and lowering a person above the frame and a second position for raising and lowering the person adjacent the frame, a jib having a first end for attachment to a harness for securement to the person, a second end located remotely from the first end, and an elbow located closer to the second end than to the first end, the elbow being disposed downwardly and pivotally attached to an upper end of the mast, and a lifting member attached between the elbow of the mast and the second end of the jib, the lifting member being extendible for lowering the first end of the jib below the upper end of the mast and retractable for raising the first end of the jib above the upper end of the mast for respectively lowering and raising the person with the harness;

an attachment means, located proximate one corner of the frame, for allowing pivotable movement of the mast with respect to the frame, and for providing a low friction support for axial and radial forces produced during raising and lowering of the person and moments of inertia produced during swinging of the person between positions over and adjacent the frame, a reinforcing means attached to the frame in the region of the attachment means for inhibiting excessive deflection of the frame during use of the bed, the reinforcing means extending at least part way along two adjoining sides of the frame at the attachment means; and, a stabilising leg attached to the frame proximate the attachment means, the stabilizing leg having a leg portion depending downwardly from the attachment means and a foot disposed downwardly from the leg portion for engagement with the floor, the stabilising leg being moveable between an in use position for resisting transverse tipping forces induced in the bed by the lifting means when the jib is in the second position and when the jib is moving between the first position and the second position, and a transport position for allowing wheeled movement of the bed.

2. A stabilised bed according to claim 1, in which the reinforcing means is a brace fixed to the frame at least part way along two sides of the frame extending from the attachment means.

3. A stabilised bed according to claim 2, in which the reinforcing means includes a plurality of beams, wherein each of the beams has a greater strength than beams which form the frame.

4. A stabilised bed according to claim 1, in which the attachment means has two roller bearings for pivoting the mast with respect to the frame and a thrust bearing for bearing vertical loads.

5. A stabilized bed according to claim 4, in which the attachment means has stops to limit the pivoting movement of the mast with respect to the frame.

6. A stabilized bed according to claim 1, in which the leg portion includes an adjustment means for adjusting the height of the foot with respect to the floor so that the foot comes into contact with the floor as the jib is moved from over the frame to adjacent the frame whilst carrying the person.

7. A bed according to claim 1, characterised in that the reinforcing means is a beam inserted into a base frame of the bed in the region of the attachment means, the beam being of greater rigidity than the remainder of the base frame.

8. A lifting apparatus according to claim 1, characterised in that the mast has a spigot carrier having bearings for distributing vertical loads, allowing pivoting about a substantially vertical axis and for resisting moments of inertia about a lower end of the mast, the spigot carrier being shaped to receive a spigot attached to the bed.

9. A stabilising leg according to claim 1, characterised in that the leg is telescopically moveable into and out of the bed.

* * * * *